US006848520B1

(12) United States Patent
Jansch

(10) Patent No.: US 6,848,520 B1
(45) Date of Patent: Feb. 1, 2005

(54) BUSHING FOR A DRILLING RIG

(75) Inventor: Manfred Jansch, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/110,022

(22) PCT Filed: Sep. 25, 2000

(86) PCT No.: PCT/GB00/03666

§ 371 (c)(1),
(2), (4) Date: Aug. 5, 2002

(87) PCT Pub. No.: WO01/25592

PCT Pub. Date: Apr. 12, 2001

(30) Foreign Application Priority Data

Oct. 6, 1999 (GB) ..... 9923554

(51) Int. Cl.[7] ..... E21B 19/06

(52) U.S. Cl. ..... 175/423; 166/75.14; 166/77.52; 464/163

(58) Field of Search ..... 175/423; 166/75.14, 166/77.52, 78.1, 88.2; 188/67; 464/163; 276/141.2; 16/2.1; 403/333, 334

(56) References Cited

U.S. PATENT DOCUMENTS

| | | | | |
|---|---|---|---|---|
| 1,400,940 A | | 12/1921 | Clarke | |
| 2,607,098 A | | 8/1952 | Wilson | 24/263 |
| 3,571,865 A | | 3/1971 | Johnson | 24/263 |
| 3,739,844 A | * | 6/1973 | Peterman et al. | 166/0.5 |
| 4,039,176 A | * | 8/1977 | Jansen, Jr. | 267/125 |
| 4,152,015 A | | 5/1979 | Jones et al. | 285/146 |
| 4,203,182 A | | 5/1980 | Boyadjieff et al. | 24/263 D |
| 4,253,219 A | | 3/1981 | Krasnov | 24/263 D |
| 4,306,339 A | | 12/1981 | Ward | 24/263 DA |
| 4,355,443 A | | 10/1982 | Blackwell | 24/263 D |
| 4,579,379 A | * | 4/1986 | Berg | 294/102.2 |
| 4,767,677 A | * | 8/1988 | Kuwayama | 428/551 |
| 4,823,919 A | | 4/1989 | Hayatdavoudi | 188/67 |
| 5,321,875 A | * | 6/1994 | Hoffman et al. | 29/271 |
| 5,544,706 A | | 8/1996 | Reed | 166/379 |
| 5,848,647 A | | 12/1998 | Webre et al. | 166/379 |
| 6,089,338 A | * | 7/2000 | Bouligny, Jr. | 175/423 |
| 2002/0134555 A1 | * | 9/2002 | Allen et al. | 166/377 |

FOREIGN PATENT DOCUMENTS

| | | | |
|---|---|---|---|
| EP | 0 359 355 | 3/1990 | E21B/33/04 |
| WO | WO 00/09853 | 2/2000 | E21B/19/08 |

OTHER PUBLICATIONS

PCT International Search Report from PCT/GB00/03666, dated Mar. 13, 2001.

* cited by examiner

*Primary Examiner*—William Neuder
(74) *Attorney, Agent, or Firm*—Moser, Patterson & Sheridan

(57) ABSTRACT

A bushing for retaining a spider and comprising a basket portion having an opening in its upper end and a base at its lower end, there being a further opening in the base to allow a tubing string to extend substantially axially through the basket portion. The bushing further comprises a flange extending at least partially around the upper opening, wherein the bushing can be suspended through an opening in a rig floor to be supported by the flange.

14 Claims, 4 Drawing Sheets

BUSHING FOR A DRILLING RIG

CROSS-REFERENCE TO RELATED APPLICATIONS

This application claims benefit of International Application No. PCT/GB00/03666, filed on Sep. 25, 2000, and published under PCT Article 21(2) in English, and claims priority of United Kingdom Application No. 9923554.1 filed on Oct. 6, 1999. The aforementioned applications are herein incorporated by reference in their entirety.

BACKGROUND OF THE INVENTION

1. Field of the Invention

The present invention relates to a bushing for a drilling rig and more particularly to a bushing suitable for retaining a spider for holding a tubing string.

2. Description of the Related Art

In a conventional drilling rig structure, a length of tubing string, composed of individual tubing sections joined end to end, extends through an opening in the rig floor. A tubing string may extend for several thousands of meters below the rig and therefore may have a considerable weight. Complex devices have been designed for holding, lifting, and rotating tubing strings.

In a typical system, a so-called "rotary table" is mounted within the opening in the rig floor. In the case where a tubing string is being used to rotate a drill bit located at the bottom of the string, a "Kelly bushing" is fitted into a central region of the rotary table (the Kelly bushing may in turn be fitted within a "master bushing"). The Kelly bushing has a hexagonally shaped passage extending through a central region. The tubing string passes through the Kelly bushing and a hexagonal outer surface region of the tubing string is engaged by the bushing. The Kelly bushing can be rotated by the rotary table to in turn rotate the tubing string and the drill bit. Other types of bushing may alternatively be fixed into the rotary table to provide for different operations and/or tubing string configurations.

Is used. A spider is a complex piece of equipment and comprises one or more hydraulically driven grippers. In use, the spider sits on top of the rotary table, with a tubing string passing through the centre of the spider and being held in place there by the grippers. The grippers can be released to allow the controlled lowering and raising of the tubing string, e.g. using an elevator.

It will be appreciated that a spider is a very large and heavy piece of equipment, and may extend to a height several meters above the surface of the rig floor. It is often necessary for operators to work above the spider, for example to join a new piece of tubing section to the top of a tubing string. This requires the operator to stand on top of an elevated platform or ladder. It will be appreciated that this can present certain risks, especially where the operator is using heavy and awkward equipment such as a power tong which is used to join sections of tubing string together.

In an attempt to overcome this problem, it is known to provide a spider which can be fitted into a space in the rig floor so that the spider is suspended beneath the floor. For example, a spider has been designed which can be located within the rotary table (after removal if necessary of the Kelly bushing), with the spider having an integral flange at an upper end thereof, which locates into a recess surrounding the opening in the rotary table, to support the spider. This spider is not a standard conventional spider and rig operators must therefore discard there old spiders and purchase a new one. Furthermore, the new spider requires a new design of adapter plate/bushing which fits into the rotary table to support the spider.

The new design of spider is suitable for use in situations where the tubing string can be rotated by way of a top drive. A top drive is typically connected to the upper end region of a tubing string. However, this spider cannot be used in situations where it is required to rotate the tubing string using a conventional Kelly bushing mounted within a rotary table this requires the use of a conventional deck-mounted spider. In order to accommodate all possible scenarios therefore, it is necessary for rig operators to maintain both a conventional spider and a below deck spider in their inventories. It has already been noted that spiders are extremely large and heavy and the need to retain two spiders represents a considerable inconvenience. In addition, the requirement for two spiders increases a rig operator's costs.

It is an object of the present invention to overcome or at least mitigate the above noted disadvantages of spiders in general and of below floor mounted spiders in particular. It is a second object of the present invention to enable a single spider to be used both above and below floor level. It is a further object of the invention to enable a conventional spider to be located below floor level. These and other objects are achieved as least in part by providing a bushing which can be suspended through an opening in a rig floor and in which a substantially conventional spider can be located.

SUMMARY OF THE INVENTION

According to a first aspect of the present invention there is provided a bushing for retaining a spider or the like and comprising a basket portion having an opening in its upper end and a base at its lower end, there being a further opening in the base to allow a tubular to extend substantially axially through the basket remember wherein the bushing can be suspended through an opening in a rig floor.

By dimensioning the bushing such that it can be suspended within a standard size opening in a rig floor, the bushing may be located in place as and when a below deck spider is required. When a surface mounted spider is required, the bushing can be removed and replaced by conventional apparatus, for example a Kelly bushing.

Preferably, the bushing comprises a flange extending at least partially around the upper opening such that the bushing can be supported by the flange when the bushing is suspended through said opening. Alternatively, the bushing may comprise tabs, rods, bolts or the like which can be used to support the bushing in the opening.

Preferably, the opening in which the bushing is suspended is an opening in a rotary table located in the floor of a rig. More preferably, the flange rests in use against a surface of the rotary table. Alternatively however, the flange may rest against an adapter unit which is in turn supported by the rotary table.

Preferably, said opening in the base of the basket portion is located in a central region of the base. More preferably, an axially extending slot is provided in a side of the bushing such that it extends through the flange, the basket sidewall, and the base. The slot allows the bushing to be located around a tubing string whilst the tubing string extends through the rig floor. Once the bushing is located around the tubing string, the bushing can be lowered through the opening in the rig floor to its working position.

Preferably, the bushing comprises means for fixing the bushing relative to the rig floor to prevent rotation of the bushing within the floor. More preferably, the fixing means are provided in the flange.

Preferably, the bushing comprises means for fixing a spider within the basket portion to prevent rotation of the spider within the bushing. More preferably, these means are provided in the base of the basket portion.

Preferably, the basket portion is substantially cylindrical in shape. More preferably, the basket portion comprises a plurality of elongate stays which extend from the base to the flange.

According to a second aspect of the present invention there is provided a bushing as set out above in combination with a rotary table, the bushing being suspended through an opening in the rotary table.

According to a third aspect of the present invention there is provided a method of mounting a spider relative to a rig floor, the method comprising the steps of:

suspending a bushing within an opening in a rig floor, the bushing being held in the opening by way of a flange which rests upon the rig floor;

mounting a spider in the bushing so that at least a major portion of the spider lies beneath the surface of the rig floor.

It will be appreciated that the step of mounting a spider in the bushing may be carried out either before or after the bushing is suspended within an opening in a rig floor.

According to a fourth aspect of the present invention there is provided a spider for holding a tubing, the spider having at least two detachable handles, wherein, when the handles are attached to the spider, the spider may be used as an elevator and, when the handles are detached, the spider may be located in a bushing for suspension beneath the surface of a rig floor.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION OF THE PREFERRED EMBODIMENT

Figure 1:
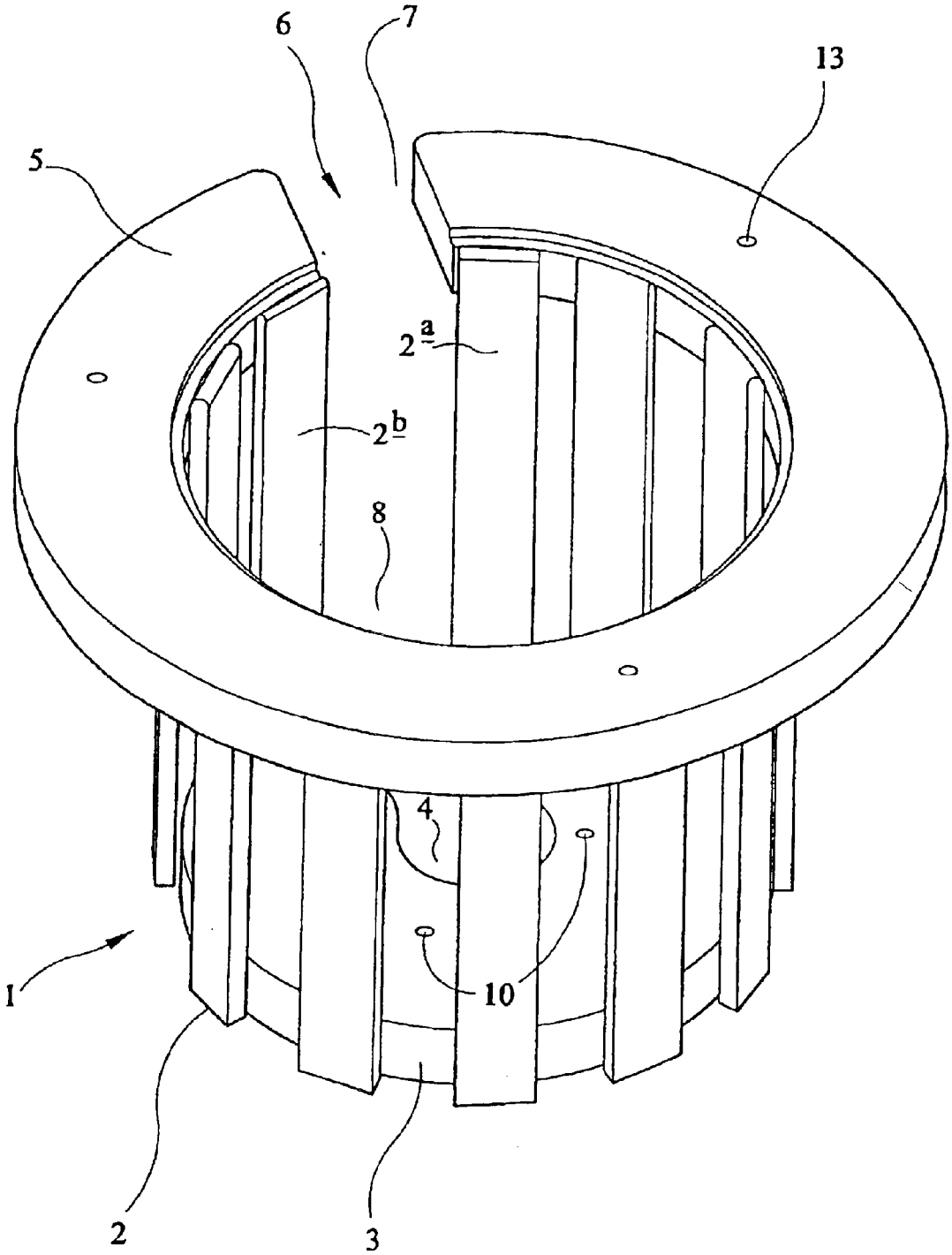
FIG. 1 illustrates in perspective view a bushing for holding a spider.

There is illustrated in FIG. 1 a bushing I which is designed to contain a spider which in turn is used to retain a tubing string which is suspended beneath a (drilling) rig. The bushing is generally cylindrical in shape and comprises a plurality of elongate metal stays 2 which are arranged axially around the periphery of a cylinder. The stays 2 are typically several meters in length whilst the diameter of the cylinder may be one to two meters. At the lower end of the bushing 1, the stays 2 are secured to a metal base 3. The base has a keyhole shaped opening 4 formed therein. The stays 2 and the base 3 together form a basket shaped portion. At their upper ends, the stays 2 are secured to an annular flange member 5.

Two of the stays 2*a*, 2*b* are spaced apart by distance which is greater than the spacing between others of the stays 2. This increased spacing forms a slot 6 which is aligned with the peripheral end of the keyhole opening 4 in the base 3. The slot 6 formed between the stays 2*a*, 2*b* is aligned with a further slot 7 which extends radially through the flange member 5. The slots 4, 6, 7 together form a single axially extending slot 8 which allows the bushing 1 to be located around a tubing string (not shown in FIG. 1) which may already be suspended beneath a rig.

Figure 2:
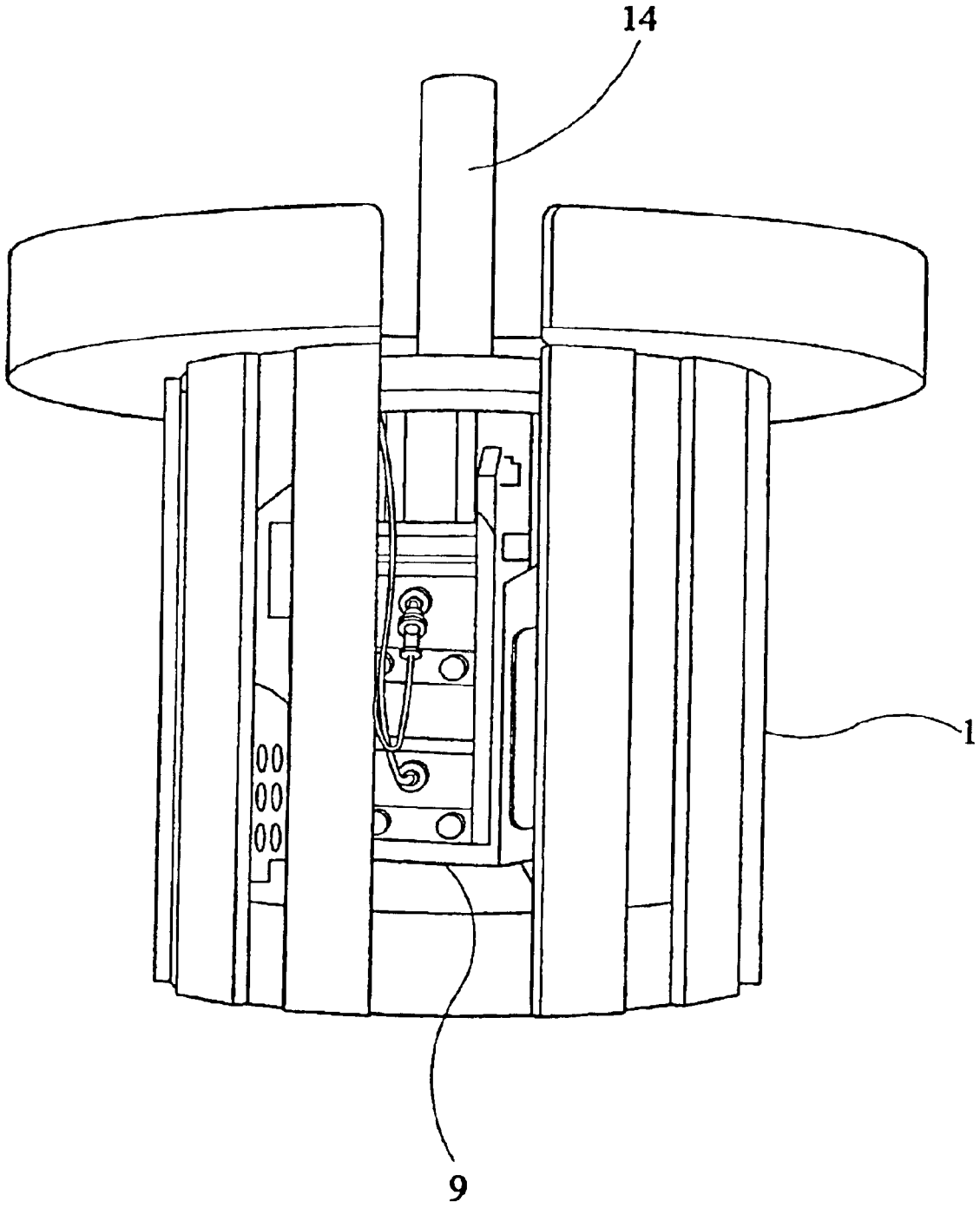
FIG. 2 illustrates in perspective view the bushing of FIG. 1 with a spider located within the bushing.

FIG. 2 illustrates the bushing I of FIG. 1 with a spider 9 located within the basket portion of the bushing. FIG. 1 illustrates locating holes 10 formed in the base 3 of the basket portion. These locating holes 10 are arranged to receive respective locating pins (not shown in the Figures) formed on the base of the spider 9, and thereby to prevent rotation of the spider 9 within the bushing 1.

Figure 3A:
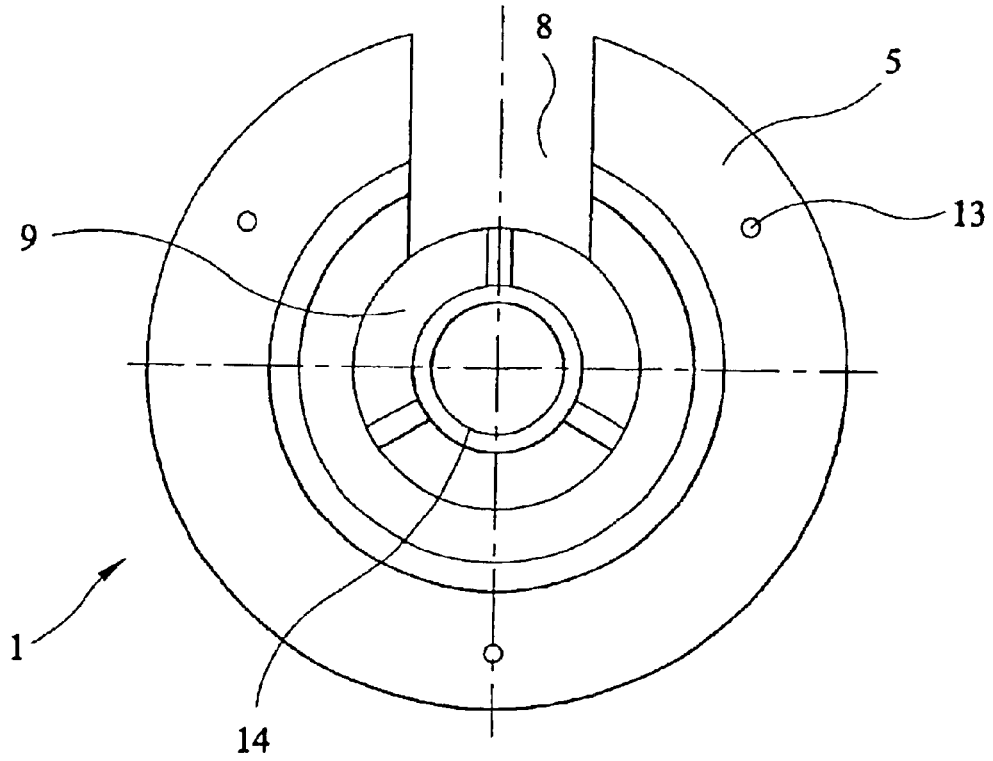
FIG. 3A illustrates schematically a plan view of the bushing and spider combination of FIG. 2 suspended within an opening passing through a rig floor.
Figure 3B:
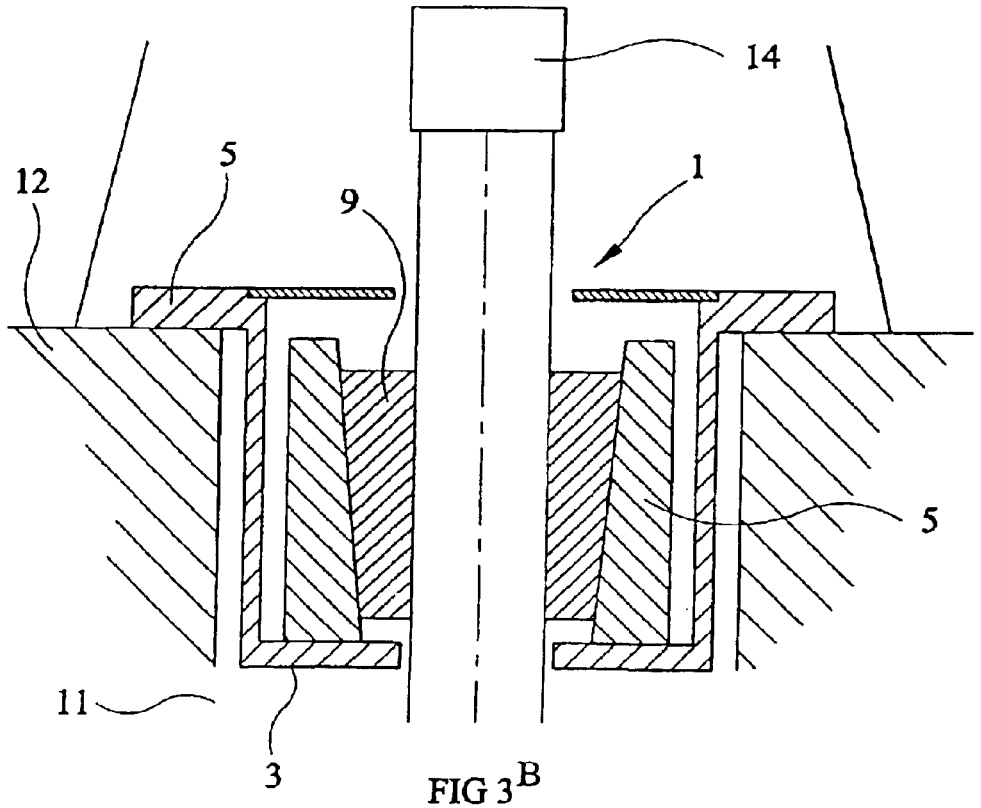
FIG. 3B illustrates schematically a vertical section through the bushing and spider combination of FIG. 2 suspended within an opening passing through a rig floor.

FIGS. 3A and 3B illustrate the bushing and spider combination of FIG. 2 located within an opening 11 passing through a rig floor 12. The spider 9 is located around a tubing string 14 above the bushing 1. The spider is then lowered into the bushing. Typically, the opening 11 is formed in a rotary table and has a standard diameter. The bushing 1 is dimensioned such that the basket portion of the bushing 1 passes through the opening 11 until the flange member 5 contacts the rim of the rotary table surrounding the opening 11. The flange member 5 supports the weight of the basket portion and the spider 9. FIGS. 1 and 3A illustrate bolt holes 13 formed in the flange member 5 which can be used to secure the flange member 5, and therefore the basket portion, within the opening 11 in the rig floor 12. This prevents rotation of the bushing I relative to the rig floor 12.

FIG. 3B illustrates a portion of a tubing string 14 passing through the spider and bushing combination. It will be appreciated from FIG. 3 that it is relatively easy for an operator to gain access to the tubing string 14 above the spider 9. There is not necessarily a requirement for the operator to use an elevated platform or ladder and the risks involved in working on the tubing string 14 above the spider 9 are reduced.

It will be appreciated that it is a relatively straightforward operation to remove the bushing 1 and the spider 9 from the rig floor opening 11. After removal of the bushing 1, it is possible to locate some other piece of equipment into the rig floor opening 11. For example, it may be required to insert a Kelly bushing (and master bushing) into the opening 11 for the purpose of rotating the tubing string 14. It will also be appreciated that the slot 8 formed in the side of the bushing 1 allows the bushing to be both located and removed whilst a tubing string 14 remains in place.

Figure 4A:
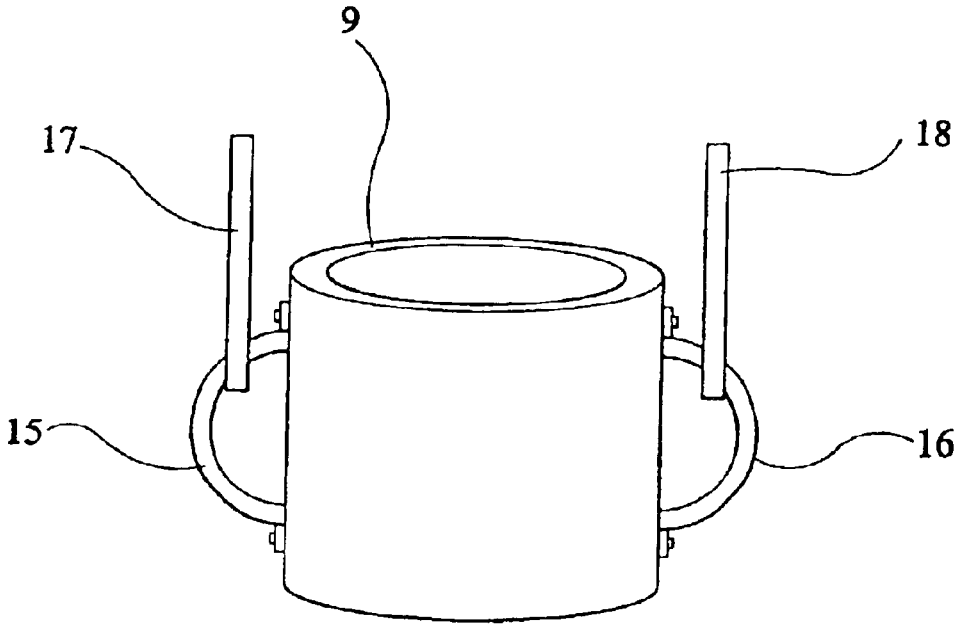
FIG. 4A illustrates schematically a spider used as an elevator and having lifting handles attached.
Figure 4B:
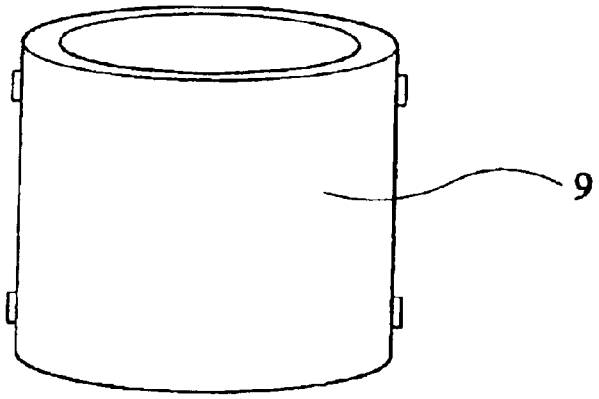
FIG. 4B illustrates schematically a spider having the lifting handles detached and fitted into a bushing.

It is known in the industry to use a spider as an elevator. For this purpose, the spider is provided with "ears" or handles which allow the spider to be raised and lowered using cables or rods. Typically, the handles are integrally moulded with the spider body and can be large relative to the spider. To allow a spider to fit inside a bushing of the type described above, it may be advantageous to provide the spider with detachable handles. For example, the handles could be bolted to the main body of the spider. Thus, when the spider is used as an elevator, the handles would be attached to the spider body to allow the spider to be raised and lowered. When it is required to use the spider as a spider, i.e. fixed relative to the rig floor, the handles could be detached and the spider fixed into the bushing. These two situations are illustrated in FIGS. 4A and 4B where the handles are indicated by reference numerals 15, 16 and the lifting rods are illustrated by numerals 17, 18.

It will be appreciated by the person of skill in the art that modifications may be made to the above described embodiments without departing from the scope of the present invention. For example, in order to maintain the upper surface of the bushing 1 flush with the surface of the rig floor 12, a step may be formed in the rig floor 12 in the rim surrounding the opening 11, with the flange member 5 being dimensioned to locate into the step.

While the foregoing is directed to embodiments of the present invention, other and further embodiments of the invention may be devised without departing from the basic scope thereof, and the scope thereof is determined by the claims that follow.

What is claimed is:

1. A drilling rig apparatus comprising:

a spider; and a bushing for retaining the spider, the bushing comprising a basket portion having an opening at an upper end thereof and a base at a lower end thereof, there being a further opening in the base to allow a tubular to extend substantially axially through the basket portion, the spider being located wholly within the bushing, wherein the bushing is suspended through an opening in a rig floor so that the spider is located beneath the surface of the rig floor.

2. The apparatus according to claim 1 and comprising a flange extending at least partially around the upper opening such that the bushing can be supported by the flange when the bushing is suspended through said opening.

3. The apparatus according to claim 2, wherein the opening in which the bushing is arranged to be suspended is an opening in a rotary table located in the floor of a rig.

4. The apparatus according to claim 3, wherein the flange rests in use against a surface of the rotary table.

5. The apparatus according to claim 1, wherein the opening in the base of the basket portion is located in a central region of the base, and an axially extending slot is provided in a side of the bushing such that it extends through a flange, the basket sidewall, and the base, wherein the slot allows the bushing to be located around a tubing string whilst the tubing string extends through the rig floor.

6. The apparatus according to claim 1, wherein the bushing comprises means for fixing the bushing relative to the rig floor to prevent rotation of the bushing within the floor.

7. The apparatus according to claim 1, wherein the bushing comprises means for fixing the spider within the basket portion to prevent rotation of the spider within the bushing.

8. The apparatus according to claim 1, wherein the basket portion is substantially cylindrical in shape and comprises a plurality of elongate stays which extend from the base to a flange.

9. The apparatus according to claim 1 in combination with a rotary table, the bushing being suspended through an opening in the rotary table.

10. A method of mounting a spider relative to a rig floor, the method comprising:

suspending a bushing within an opening in a rig floor, the bushing being held in the opening by way of a flange which rests upon the rig floor;

aligning at least one pin on the spider with at least one locating hole in the bushing; and mounting a spider in the bushing so that the spider is wholly contained within a basket of the bushing such that the spider lies beneath the surface of the rig floor.

11. A spider for holding a tubing, the spider having at least two detachable handles constructed and arranged to support the spider each handle attached to the spider by at least one releasable member, wherein, when the handles are attached to the spider, the spider may be used as an elevator and, when the handles are detached, the spider may be located in a bushing for suspension beneath the surface of a rig floor.

12. An assembly for use at a wellsite, comprising:

a spider; and a bushing for retaining the spider below a surface of a rig floor, the bushing having a basket portion and a flange portion, wherein an axial slot is formed through both the basket portion and the flange portion to permit a tubular to extend through the bushing.

13. A bushing for retaining a spider below the surface of a rig floor, comprising:

a cylindrical member having an annular flange at an upper end thereof, a base at a lower end thereof and a plurality of elongate members extending from the annular flange to the base, wherein an axial slot is formed through the cylindrical member, the annular flange, and the base for extending a tubular therethrough.

14. The bushing of claim 13, wherein the base includes a keyhole shaped opening formed therein to receive a tubular member.

* * * * *